United States Patent [19]

Glickman et al.

[11] Patent Number: 4,889,304

[45] Date of Patent: Dec. 26, 1989

[54] ALL PLASTIC DISPLAY HOOK WITH LOCKING FEATURE

[75] Inventors: Joel I. Glickman, Huntingdon Valley; Robert F. Pflug, Quakertown, both of Pa.

[73] Assignee: Trion Industries, Inc., Wilkes-Barre, Pa.

[21] Appl. No.: 200,931

[22] Filed: Jun. 1, 1988

[51] Int. Cl.[4] ..... A47F 7/00; E04G 3/00

[52] U.S. Cl. ..... 248/222.1; 248/220.4; 248/223.1; 211/59.1

[58] Field of Search ..... 248/222.1, 220.4, 221.1, 248/221.2, 221.3, 223.1; 211/54.1, 59.1, 57.1

[56] References Cited

U.S. PATENT DOCUMENTS

| | | | |
|---|---|---|---|
| 1,938,370 | 12/1933 | Bodkin | 248/221.1 |
| 2,841,353 | 7/1958 | Burdick | 248/220.3 |
| 2,859,008 | 11/1958 | Zimmer | 248/221.2 |
| 2,987,286 | 6/1961 | Alling | 248/220.3 |
| 3,163,392 | 12/1964 | Husted . | |
| 3,241,799 | 3/1966 | Terlinde | 248/221.2 |
| 3,452,954 | 7/1969 | Lucietto et al. . | |
| 3,891,172 | 6/1975 | Einhorn . | |
| 4,017,943 | 4/1977 | Moore | 248/221.3 X |
| 4,319,730 | 3/1982 | Thalenfeld . | |
| 4,362,249 | 12/1982 | Thalenfeld . | |
| 4,750,698 | 6/1988 | Barnes | 248/220.4 |

FOREIGN PATENT DOCUMENTS

| | | | |
|---|---|---|---|
| 258524 | 3/1967 | Austria | 248/220.3 |
| 1130001 | 10/1968 | United Kingdom | 248/221.2 |

*Primary Examiner*—Alvin C. Chin-Shue

*Attorney, Agent, or Firm*—Schweitzer & Cornman

[57] ABSTRACT

A merchandise display hook for apertured panelboard displays, preferably of all-plastic construction for manufacture by injection molding, is provided with an optionally useable locking key which is installed after mounting of the display hook, to prevent accidental removal thereof. The base of the display hook is formed with a rearwardly opening guide channel arrangement which provides for the reception and guidance of front and back guide legs for the locking key, by means of which the key is installed on and secured to the display hook. Provision is made for removal of the key, when necessary, by insertion of a small tool.

4 Claims, 1 Drawing Sheet

ALL PLASTIC DISPLAY HOOK WITH LOCKING FEATURE

BACKGROUND AND SUMMARY OF INVENTION

Point of purchase display of prepackaged merchandise makes extensive use of perforated panelboard displays, in which the merchandise is suspended on removable display hooks. A wide variety of such display hooks is available. Typically, such hooks include a base member provided with rearwardly extending, upturned, L-shaped lugs arranged to be passed through an adjacent pair of apertures in the panelboard when the base member is in an upwardly tilted orientation. When the base member is pivoted downward flush with the panelboard, the device is locked in place by the L-shaped lugs. A merchandise supporting element, most typically in the form of an elongated wire or rod, extends outward from the base to provide means for suspending the display merchandise.

Most conventional panelboard display hooks are subject to the possibility of accidental dislodgment from the panelboard if accidentally tilted upward. In many cases, the problem is more theoretical then real. However, for certain types of display hooks, the possibility of accidental dislodgment is sufficiently great that special steps are taken to prevent or minimize such occurrences. Especially where the hooks are made entirely of plastic material, there is a great deal of resiliency in the outwardly projecting merchandise support element. As a result, not only is it possible to dislodge the hook by an accidental upward tilting, but also an accidental downward deflection of the support element may tend to cause upward pivoting of the device when the deflecting force is released. Accordingly, it is particularly desirable in a case of all plastic hook constructions to utilize means for retaining the device in its installed condition.

One advantageous prior proposal for this purpose is the subject of the David R. Thalenfeld U.S. Pat. No. 4,319,730, assigned to Trion Industries Inc. This patent discloses a display hook of all-plastic construction, which is provided with an integral, upwardly extending, flexible tongue positioned to overly the front face of the panelboard and to resiliently restrain upward pivoting action of the hook. In an alternative embodiment, illustrated in the same patent, a conventional metal display hook is provided with an auxiliary plastic attachment including an integral, upwardly extending, flexible tongue whose function is similar to the integral plastic tongue of the all-plastic version.

In the Thalenfeld U.S. Pat. No. 4,362,249, a two-part display hook, comprising a plastic base and a wire merchandise support is provided with an integral, flexible tongue, extending upward from the base member and adapted to overlie the front face of the panelboard. The illustrated construction requires the metal support element to be assembled after installation of the plastic base member. After such assembly, the metal merchandise support element serves to lock the plastic tongue against deflection.

In the Lucietto, et al. U.S. Pat. No. 3,452,954, a plastic base member is provided with a U-shaped wire locking element which, when retracted, enables installation and removal of the plastic base member in a normal fashion. After assembly, the U-shaped locking member is pushed upwardly, such that an upwardly extending portion thereof overlies the front face of the panelboard to prevent unintended removal of the display device.

In accordance with the present invention, a novel and improved display hook construction is provided, preferably for a hook of all-plastic construction, which incorporates improved and highly advantageous means for locking the display device in position on the panelboard to prevent accidental removal or dislodgment. The device of the invention includes a precision molded base member, provided in the usual fashion with rearwardly and upwardly projecting L-shaped mounting lugs. In addition, guide means are provided on both the front and back surfaces of the plastic base for the semi-removable reception of a locking key, which functions to secure the base member against upward tilting movement and thereby to prevent accidentally dislodgment. Significantly, the locking key is designed to be produced as a separate part by precision injection molding, which is maintained separate from the body member until after installation of the display device on a panel display. In this respect, it is an intended feature of the invention that the display device may, if desired, be used without the locking key wherever desired, and that the locking key be installed as and when desired by the merchandise manager.

Pursuant to a specific feature of the invention, the locking key is provided with a plurality of downwardly extending guide elements, which cooperate with vertical guide surfaces on the front and back of the base member. Certain of the guide elements are provided with means providing mutual locking engagement with the base member, when the locking key is assembled thereto. Such locking means allow the key to be removed only with a certain degree of difficulty, to inhibit removal by unauthorized person. Desirably, the base member and locking key are so designed as to accommodate the use of a small tool to free the locking key, when desired.

For a more complete understanding of the above and other features and advantages of the invention, reference should be made to the following detailed description of a preferred embodiment, and to the accompanying drawing.

DESCRIPTION OF PREFERRED EMBODIMENT OF THE INVENTION

Figure 1:
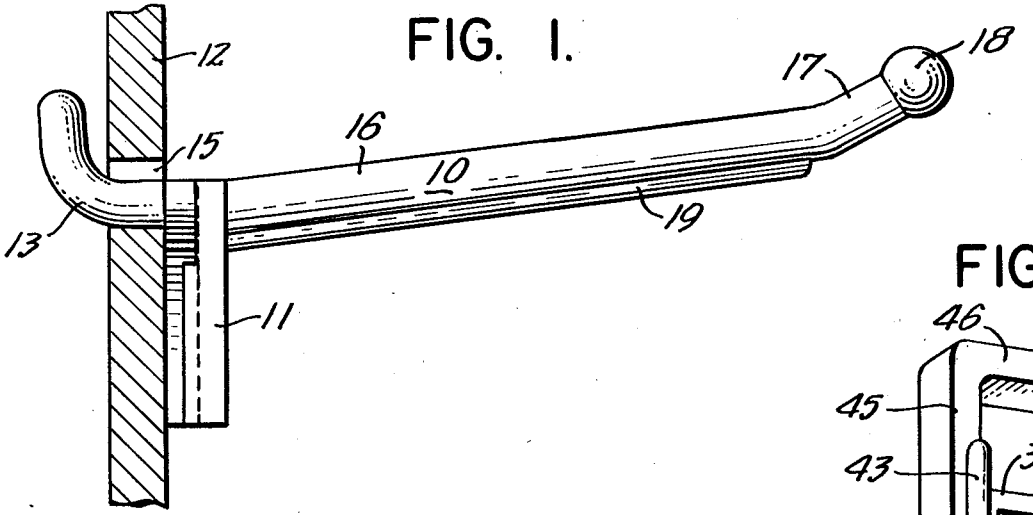
FIG. 1 is a side elevational view of a display hook according to the invention, shown mounted on an apertured panelboard, but without the locking key in position.
Figure 2:
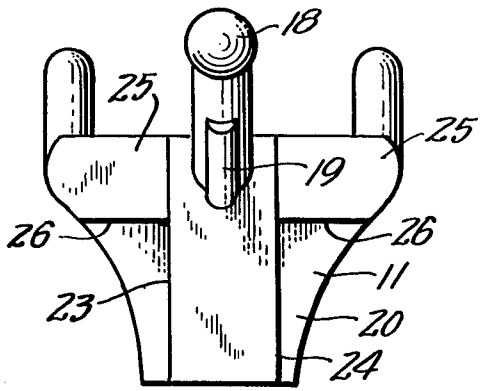
FIG. 2 is a front elevational view of the display hook device of FIG. 1.
Figure 3:
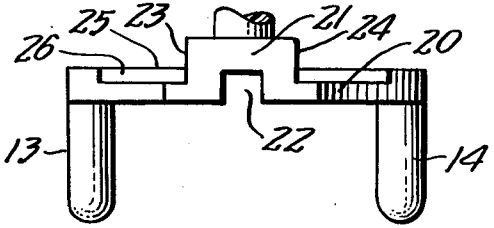
FIG. 3 is a bottom plan view of the device of FIG. 1 with parts broken away.

Referring now to the drawing, the reference numeral 10 designates generally a merchandise display hook constructed in accordance with the invention and advantageously of an all-plastic construction. As its basic component elements, the display hook includes a base member 11, which is arranged to be positioned in overlying relation to the front face of an apertured panel 12. Projecting rearwardly from the upper portions of the base 11 are horizontally spaced L-shaped mounting lugs 13, 14. These are of a size and configuration to be insertable through apertures 15 in the panel 12, when the hook is tilted upwardly. After the hook is tilted downward, to the position shown in FIG. 1, it is locked in place by engagement of the L-shaped lugs 13, 14 with the back of the panel 12. A merchandise support element 16, of elongated rod-like configuration, extends outwardly from the front face of the base 11 desirably at a slight upward incline. At the outer extremity of the element 16 is a more sharply uptilted portion 17 terminating in a spherical element 18 for safety purposes. Where the support element 16 is formed of plastic material, it is desirable to provide a strengthening rib 19, extending along its underside.

With the display hook structure as illustrated in FIG. 1, accidental dislodgment of the display hook can occur if the hook is bumped and caused to tilt upwardly to a position in which the lugs 13, 14 can withdraw from the apertures 15. In addition, where the hook is of all-plastic construction, the outwardly extending merchandise support element 16 inherently has a certain degree of resilience and deflectability. Ifthe support element 16 becomes deflected downwardly by accidental contact, it can happen that the momentum of the return motion causes the hook to tilt upwardly and become dislodged. Accordingly, it is known in the art as hereinabove described, to provide means to prevent or inhibit such upward tilting movement, so that the display hook does not become dislodqed from the panelboard 12, unless such a result is intended.

Pursuant to the invention, the display hook device is especially designed and adapted for the reception of a novel and advantageous form of locking key, which is readily installed after initial mounting of the hook and which serves thereafter to prevent unintended dislodgment thereof. The display device and locking key are designed not only to be functionally effective in a most advantageous manner, but also to accommodate high-volume mass production by injection molding procedures, such that the device may be marketed with economies acceptable to the marketplace. In this respect, users of display hooks typically are very cost conscious, as the cost of the hooks is viewed as an overhead cost item. By way of example, the device may be advantageously molded of "K-resin", a styrene based material marketed by Phillips Petroleum, and of "Celcon", an acetyl material marketed by Celanese.

In the illustrated form of the invention, the base member 11 includes a generally flat body portion 20. The center portion of the body is formed by a vertical guide channel 21 which defines a rearwardly opening, vertically extending channel 22 of generally rectangular cross-section. The closed side of the guide channel projects forwardly from the flat body portion 20 of the base and defines a pair of laterally facing vertical guide surfaces 23, 24.

Extending horizontally across the upper portion of the base member 11 are integral reinforcing sections 25, the lower edges 26 of which define downwardly facing abutment surfaces.

Pursuant to the invention, a novel and advantageous form of locking key 30 is provided, for cooperative association with the display hook after it is mounted on the panelboard. The locking key, shown in FIGS. 4–8, is of a precision injection molded plastic construction, customarily of the same material used in forming the display hook itself.

Figure 8:
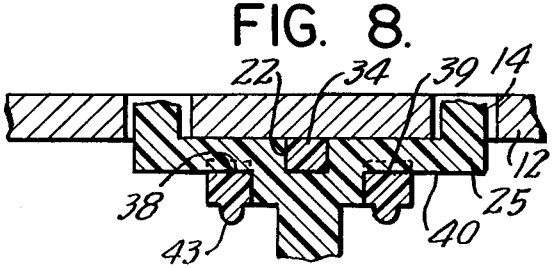
FIG. 8 is a fragmentary, cross-sectional view as taken generally on Line 8—8 of FIG. 7.

The locking key 30 includes a main cross member 31, which can be of generally rectangular cross-section and extends horizontally. Extending downward from the cross member are front guide legs 32, 33 and a single rear guide leg 34. The cross-section of the rear guide leg 34 is substantially identical to the cross-section of the rearwardly facing channel groove 22 such that, when the display hook is mounted in its normal position against the front face of the panel 12, the rear guide leg 34 can still be received within the channel 22, substantially as indicated in FIG. 8. Desirably, the lower portion of the rear guide leg 34 is provided with a tapered surface 35 on at least its rearwardly facing surface, to facilitate insertion of the guide member into the channel space 22.

The front guide legs 32 33 are positioned adjacent the forward edge of the main cross member 31 and project vertically downward in straddling relation to the sidewall surfaces 23, 24 of the guide channel 21. Desirably, the forward guide legs are provided with inwardly facing guide surfaces 36, 37 arranged to closely and slidingly embrace the channel side surfaces 23, 24. Accordingly, the locking key 30 may be installed on a display hook by inserting the rear guide leg 34 into the channel space 22 and pressing downward on the locking key. The front guide legs 32, 33 are received in closely straddling relation to the guide channel 21, and the rearward facing surfaces 38, 39 of the front guide legs bear closely against the front surface 40 of the horizontal reinforcing sections 25. The arrangement is such that the guide legs 32, 34 firmly support the locking key 30 in position relative to the vertical guide channel 21, against front to back and side to side movements.

To particular advantage, the lower extremities of the front guide legs 32, 33 are provided with rearwardly projecting offsets 41 which, when the key is properly seated on the display hook, lockingly engage with the downwardly facing abutment surfaces 26 of the reinforcing sections 25 and effectively prevent unintended dislodgment of the locking key from its operative position. The lower portions of the offsets 41 may be tapered as at 42, to facilitate application of the locking key, by initially deflecting forwardly the front guide legs 32, 33 allowing the offset portions to pass over the front of the reinforcing member 25. The location of the offsets 41 is such, as shown in FIG. 6, that, with the key fully seated, the offsets just clear the abutment surfaces 26, locking the key firmly in position.

Figure 4:
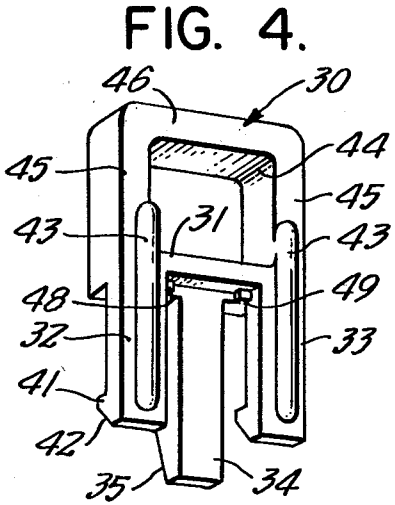
FIG. 4 is a perspective view of a locking key device, usable with the display hook of FIG. 1, for securing the same in installed position in an apertured display board.
Figure 5:
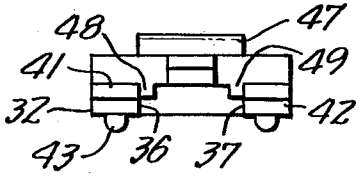
FIG. 5 is a bottom plan view of the locking key of FIG. 4.

As is evident in FIG. 4, the rear guide leg 34 is of somewhat greater length than the front guide legs 32, 33. This facilitates application of the locking key by enabling the rear guide leg 34 to be inserted within the channel space 22 before any part of the display hook is contacted by the front guide legs 32, 33. After the back leg 34 is partially inserted, the front guide legs are in substantial alignment with the guide channel 22 and completion of the installation is facilitated.

Figure 6:
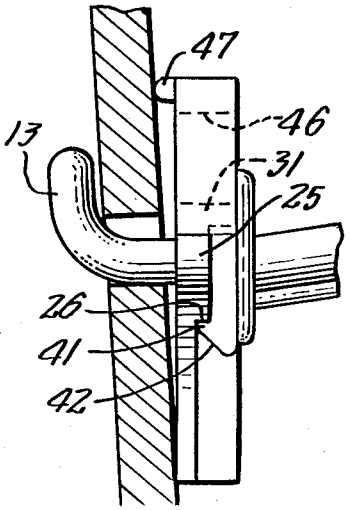
FIG. 6 is a side elevational view, similar to FIG. 1, with parts broken away, and showing the locking key installed on the base member of the display hook.

As will be evident in FIG. 6, when the key is applied to the display hook, the front guide legs 32, 33 must be cammed forwardly by the surfaces 42 to allow the offset locking portions 41 to clear the front surfaces of the reinforcing sections 25. As soon as the locking portions clear the lower surface 26, the front guide legs will return to their normal positions, causing the key to be locked in its installed position.

Where desired, the front guide legs 32, 33 may include vertical reinforcing ribs 43, which preferably extend somewhat above the horizontal member 31, to reinforce the legs in the areas of greatest deflection stress.

The upper portion 44 of the locking key advantageously may be of inverted U-shaped configuration. The opposite side legs 45 of the upper portion are integral with and extend upwardly from the front guide legs 32, 33, but are of substantially greater thickness in the front-to-back direction, such that the principal back surfaces of the upper portion 44 are generally flush with the back surface of the base member 11. An integral upper cross member 46 connects the upper ends of the side members 45 and, to advantage, may include a rearwardly projecting rib 47 (FIG. 6). The rib 47 is adapted, when the key is attached to an installed display hook, to bear against the front surface of the panelboard, ideally applying a slight forward pressure to the upper portion of the key.

The upper portion of the locking key extends to a height substantially above the lower portions of the L-shaped lugs, and desirably to a height above the upper extremities of the lugs, as is reflected in FIG. 6.

While installation of the locking key is intended to be quickly and easily accomplished, removal thereof is intentionally somewhat more difficult, in order to avoid or minimize unauthorized removal. To this end, one procedure for removal of the locking key involves simultaneously lifting forwardly the lower ends of the two forward guide legs 32, 33, to clear the locking portions 41. Advantageously, however, provision is made for the use of a simple tool, such as a small screwdriver, to lift the key free of its locked position.

Figure 7:
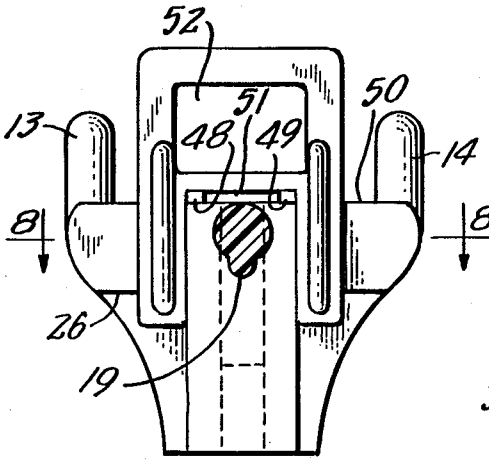
FIG. 7 is a front elevational view of the assembled display hook and locking key of FIG. 6.

With reference particularly to FIGS. 4 and 7, the locking key is advantageously provided adjacent each of the forward guide legs 32, 33, at the upper extremities thereof with spaced abutment surfaces 48, 49 which, when the locking key is in fully inserted and locked on the display hook 10, bear against the upper surfaces 50 of the base member reinforcing portions 25. This causes the horizontal bar 31 of the locking key to be spaced slightly above the upper surface 50, as shown in FIG. 7, providing an access space 51 for the insertion of a small tool. Using this feature, a small screwdriver, for example, may be inserted in the access space 51 and twisted. Sufficient upward force can be developed in this manner to cause the guide legs 32, 33 and the respective locking portions 41 to be deflected enough to become released from their locked positions. The key will then move upwardly a short distance, where it can easily be gripped manually, or lifted out by insertion of the tool into the central open space 52 in the upper portion of the locking key. The open configuration of the upper portion of the locking key facilitates installation and removal of the key by providing for easy gripping thereof.

The device of the invention is designed to accommodate manufacture by mass production injection molding techniques, which enable the parts to be produced with a high degree of precision yet at extremely low cost.

Although the display hook device is especially designed and adapted for use with the locking key, it can also be used without the locking feature, where that is desired. In this respect, the design of the hook portion of the device is such that its special adaptations for the locking key are unobtrusive. Neither the appearance of the device nor its manufacture cost are compromised by the special features provided.

The locking key itself is designed to be easily applied, but removable only with an increased degree of difficulty, so that removal by other than authorized persons is discouraged. Authorized removal is, on the other hand, facilitated by the provision of an unobtrusive tool entry opening, accommodating the insertion of a small screwdriver or the like, by which the locking key may be easily freed from its locked position and then manually removed, enabling the display hook to be removed from its mounted position on the panelboard.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. In a merchandise display hook for mounting on an apertured display board and of the type including a base portion having spaced L-shaped mounting lugs, a support element extending forwardly from said base member, and locking means for preventing upward tilting of said base portion, the improvement characterized by (a) said base portion and said support element being integrally formed of plastic material, (b) a locking key of molded plastic construction comprising an upper body portion and a plurality of integral vertically downwardly extending guide legs, (c) said guide legs including a rear, centrally disposed leg and a pair of front legs arranged in straddling relation to said rear leg, (d) said front and back guide legs straddling said base portion on the front and back sides thereof, (e) vertically extending guide means on the front and back of said base portion for receiving and supporting said front and back guide legs, (f) said vertically extending guide means comprising an integral, vertically extending forwardly projecting ridge-like central section of said body portion, (g) said ridge-like section having a rearwardly opening vertical channel therein for receiving the rear leg of said locking key and forwardly and outwardly facing, vertically extending surfaces for supporting said front guide legs, and (h) interlocking means on at least certain of said guide legs and said base portion whereby, upon assembly of said locking key to said base portion, said key is lockingly secured to said base portion.

2. A merchandise display hook according to claim 1, further characterized by (a) the integral upwardly extending portion of said locking key having, when said key is installed, a back surface generally coincident with and forming an extension of the back surface of said base portion, and (b) a spacing element projecting rearward from upper extremities of said locking key and adapted to bear against the front surface of a display board to displace said locking key forwardly therefrom.

3. A merchandise display hook according to claim 1, further characterized by (a) cooperating spacer means on said locking key and said base portion providing a tool access space for the forcible removal of said locking key.

4. In a merchandise display hook for mounting on an apertured display board and of the type including a base portion having spaced L-shaped mounting lugs adjacent its upper edge, a support element extending forwardly from said base portion, and locking means for preventing upward tilting of said base portion, the improvement characterized by (a) said base portion being formed of plastic material and having an integral, forwardly disposed guide channel portion, (b) said guide channel forming a rearwardly opening vertically extending guide groove open at the top, (c) said guide channel portion further having a forwardly projecting portion defining spaced, oppositely facing vertically extending guide surfaces, (d) front facing surfaces of said base portion, adjacent to and outwardly of said oppositely facing surfaces, forming cooperating guide surfaces, (e) a locking key member of molded plastic construction and provided with a plurality of vertically downwardly extending guide legs, (f) a first one of said guide legs being closely receivable in, and extending downwardly in, said rearwardly opening guide groove, (g) a spaced pair of said guide legs positioned in straddling relation to said first guide leg and being receivable in close-contacting relation to said oppositely facing guide surfaces and in front of said cooperating guide surfaces, (h) said locking key having an integral body portion, supported by said guide legs, extending upward to a height substantially above the lower portions of said mounting lugs, (i) at least certain of said guide legs having means for interlockingly engaging with said base member for locking said key in its mounted position on said base portion, (j) said first guide leg being of greater length than said spaced pair of guide legs and being receivable in said guide groove prior to contact between said spaced pair of guide legs with said guide surfaces.

* * * * *